United States Patent [19]

Davis

[11] Patent Number: 4,941,254

[45] Date of Patent: Jul. 17, 1990

[54] METHOD FOR PRODUCING A MOTION TRANSMITTING AND AMPLIFYING DEVICE

[76] Inventor: Allen V. C. Davis, 21111 Plummer St., Chatsworth, Calif. 91311

[21] Appl. No.: 443,907

[22] Filed: Dec. 20, 1989

Related U.S. Application Data

[62] Division of Ser. No. 284,947, Dec. 14, 1988, Pat. No. 4,891,479.

[51] Int. Cl.[5] ..... H01H 11/00

[52] U.S. Cl. ..... 29/622; 200/468

[58] Field of Search ..... 29/622; 200/408, 409, 200/468; 337/318, 319

[56] References Cited

U.S. PATENT DOCUMENTS

| | | | |
|---|---|---|---|
| 3,822,577 | 7/1974 | Roberts | 72/379 |
| 4,118,610 | 10/1978 | Purssell et al. | 29/622 |
| 4,145,587 | 3/1979 | Purssell | 29/622 |
| 4,796,355 | 1/1989 | Burch et al. | 29/622 |
| 4,803,774 | 2/1989 | Morris et al. | 29/622 |
| 4,815,312 | 3/1989 | Jacquet et al. | 72/379 |

*Primary Examiner*—P. W. Echols

*Attorney, Agent, or Firm*—Wagner & Middlebrook

[57] ABSTRACT

A method for producing a resilient element such as a thin flat plate or disc spring, commonly known as a "Belleville" spring is disclosed. The spring is capable of deflecting along an axis normal to its surface is modified in the process to include an amplifying segment disposed in a central aperture in the form of an approximately "W" shaped strip connected at its ends to opposite positions on the inner margin of the central opening. The central portion of the "W" forms an inverted "U" which is subjected in the process, after positioning within the central aperture, to torquing stress in the plane of the material to bring the ends of the open end of the "U" slightly closer together than the inner edges of the "U" nearest its closed end. One of a pair of switch contacts is affixed to the closed end of the "U" shaped portion of the device in position to be opposite another contact carried on the switch bases. In its normal finished usage devices are provided for applying pressure, normal to the plane of the material, on some position of the peripheral sensing spring in which the ends of the "W" shaped portion connect with the inner margin of the central opening of the sensing spring and when such pressure rises to a predetermined level, the "U" shaped portion will snap over to a position in which the contact which it carries will assume an opposite portion with respect to the contact carried by the switch frame.

3 Claims, 3 Drawing Sheets

FIG. 8
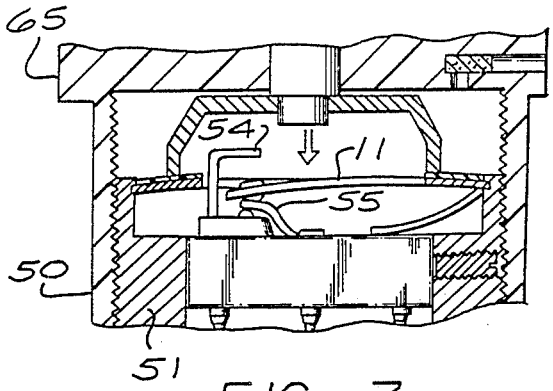
FIG. 7
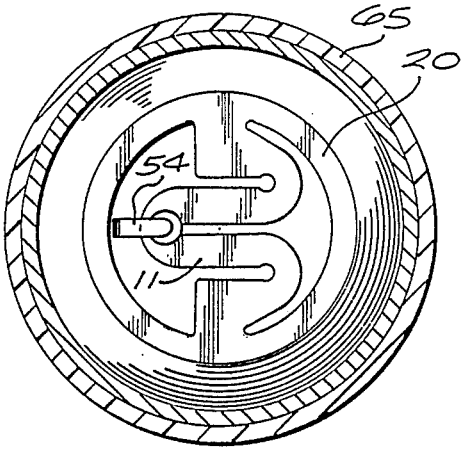
FIG. 3
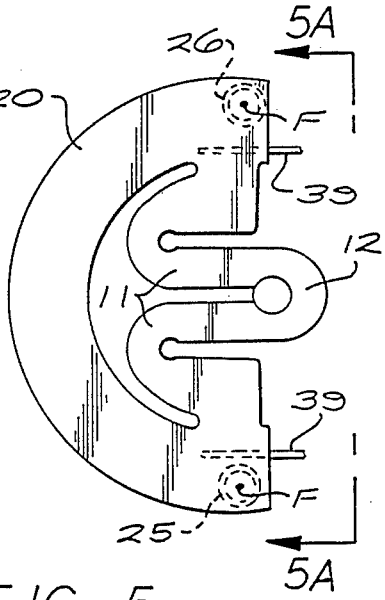
FIG. 5
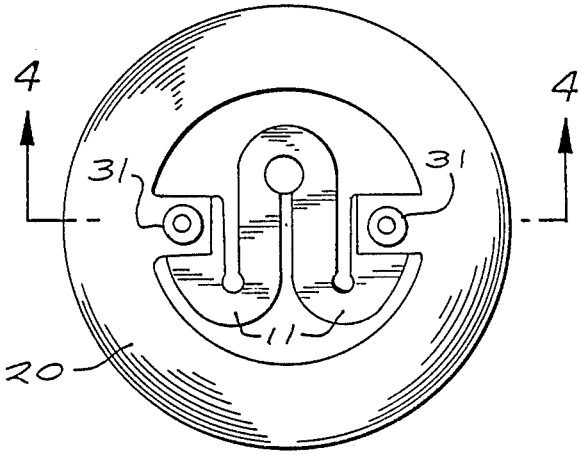
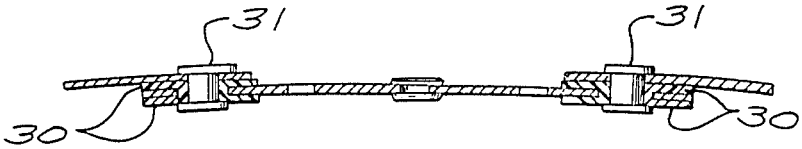
FIG. 4

FIG. 5A
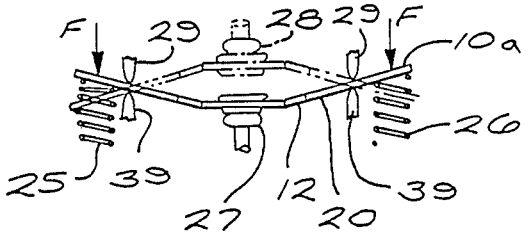
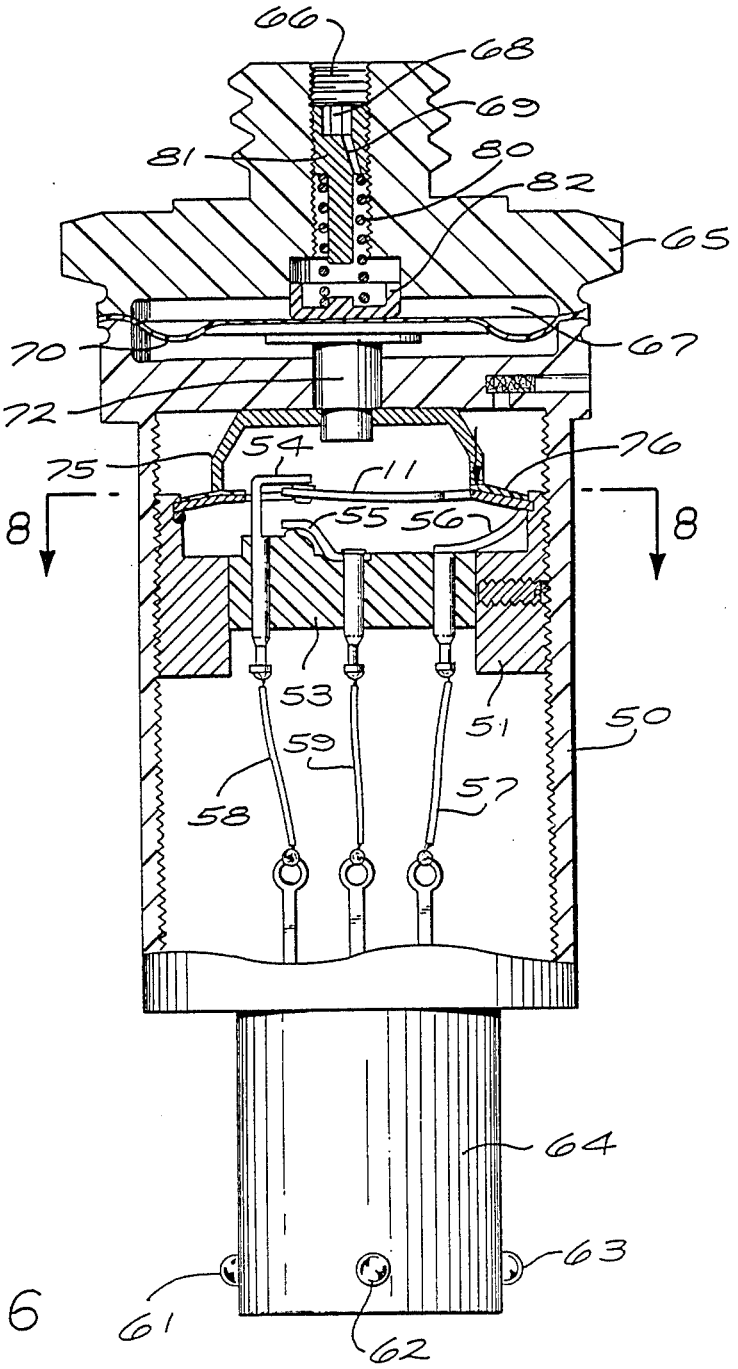
FIG. 6

METHOD FOR PRODUCING A MOTION TRANSMITTING AND AMPLIFYING DEVICE

REFERENCE TO RELATED APPLICATIONS

This is a divisional application of U.S. Application No. 284,947 filed Dec. 14, 1988 for a CONTROL ACTUATOR AND SWITCH, now U.S. Pat. No. 4,891,479.

BACKGROUND OF THE INVENTION

1. Field of the Invention

The present invention relates to improvements in snap action devices for transmission and amplification of control movements. Such devices are especially useful in electrical switches and analogous devices in which a small sensing movement such as that of a temperature or pressure sensor is to be translated into a larger, and usually snap action, movement of an electrical contact or analogous element.

2. Description of the Prior Art

Devices for the transmission and amplification of snap action movement are disclosed in the British patent of Grey No. 405,441 and U.S. patent of Proctor No. 2,200,995 both of which utilize levers, pivots and secondary springs to amplify movements and produce snap action in an opening and closing electrical contacts. While this type of structure is still widely in use, it is subject to drifting of the actuation points due to its mechanical complexity. Simplification of this type of device is disclosed in the U.S. patents of this inventor, Davis No. 2,824,919 and No. 3,472,980 wherein a simple disc spring both senses the actuation pressure and provides a snap deflection movement to actuate a device utilizing lever amplification to operate electrical contacts.

It is a primary object of the present invention to provide, in an integral unit, a device for effecting amplification sufficient to directly perform a secondary function, such as opening and closing electrical contacts, valve poppets or analogous devices, by means of a unitary structure which accomplishes the sensing function and simultaneously effects the amplification and deflection without the use of pivoted levers or secondary springs.

SUMMARY OF THE INVENTION

According to the present invention, a resilient element such as a thin flat plate or disc spring, commonly known as a "Belleville" spring, which is capable of deflection along an axis normal to its surface is modified to include an amplifying agent disposed in a central aperture in the form of an approximately "W" shaped strip connected at its ends to opposite positions on the inner margin of the central opening. The central portion of the "W" forms an inverted "U" which is subjected, after positioning within the central aperture, to torquing stress in the plane of the material to bring the ends of the open end of the "U" slightly closer together than the inner edges of the "U" nearest its closed end.

According to the present invention, it has been discovered that a small rotational displacement normal to the plane of the material of the ends of the "W" connected to the margin of the central opening will result in a snap deflection of considerable magnitude at the closed end of the "U" shaped portion in a direction normal to that plane. A slight displacement of the "W" also occurs if the device is supported at its outer periphery.

In applying this device to the operation of an electrical switch, one of a pair of contacts is mounted on the closed end of the "U" shaped portion of the device opposite another contact carried on the switch base. Means are provided for applying pressure, normal to the plane of the material, on some position of the peripheral sensing spring in which the ends of the "W" shaped portion connect with the inner margin of the central opening of said sensing spring and when such pressure rises to a predetermined level, the "U" shaped portion will snap over to a position in which the contact which it carries will assume an opposite portion with respect to the contact carried by the switch frame.

DESCRIPTION OF THE DRAWINGS

FIG. 3 is a view in plan of a modified form of the motion transmitting and amplifying device of the present invention.

FIG. 4 is a view in section of the device of FIG. 3 taken on the line 4—4 of FIG. 3.

FIG. 5 is a view in plan of a second modified embodiment of a motion transmitting and amplifying device embodying the present invention.

FIG. 5A is a fragmentary view in side elevation of an assembly employing a modification employing a device made from a flat sheet and employing separate restoration springs.

FIG. 6 is a sectional view in side elevation of a pressure sensitive switch embodying the motion transmitting and amplifying device of the present invention.

FIG. 7 is a fragmentary sectional view in side elevation of the switch of FIG. 6 showing the actuated position of the motion transmitting and amplifying device.

FIG. 8 is a view in horizontal section of the switch of FIG. 6 taken on the line 8—8 of FIG. 6.

DESCRIPTION OF THE PREFERRED EMBODIMENTS

Figure 1:
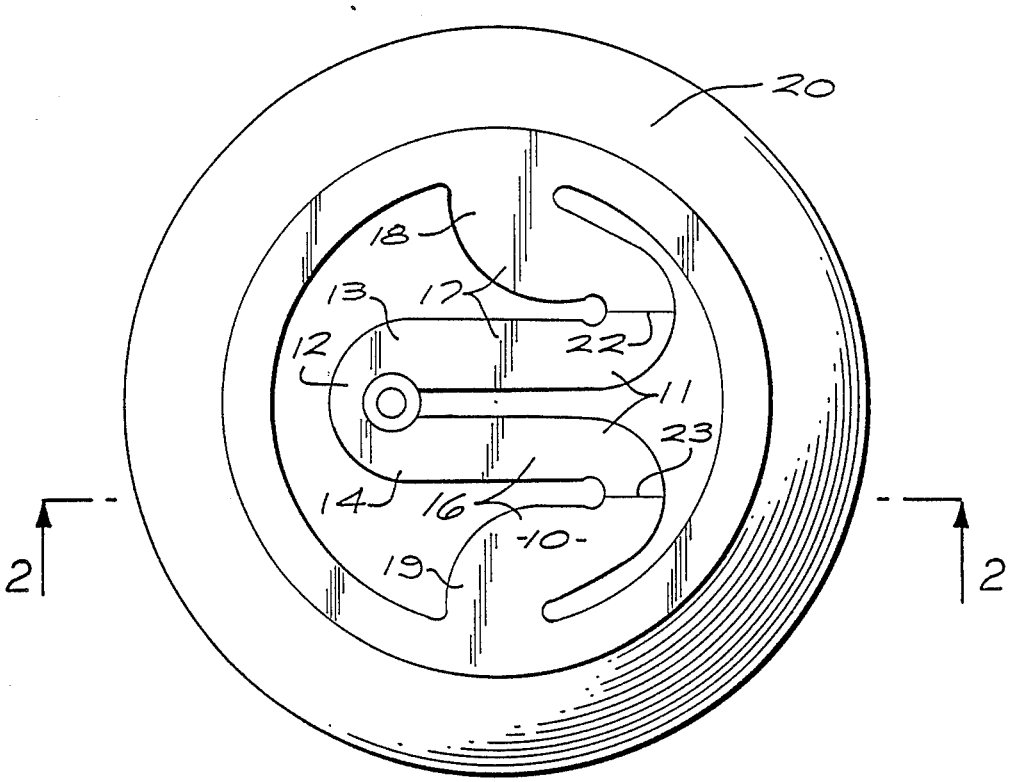
FIG. 1 is a view in plan of a motion transmitting and amplifying device embodying the present invention.

As shown in the accompanying drawings, one form of the motion transmitting and amplifying device of the present invention comprises thin strip 10 of spring metal the shape of which approximates that of the letter "W" which includes a central output loop 11 in the shape of an inverted letter "U", having a closed free end 12 and generally parallel legs 13 and 14. Each of the legs 13 and 14 is integrally connected at one end thereof to one of a pair of driver loops 16 and 17 each of which has an oppositely extending end 18 and 19.

Means are provided for constraining the oppositely extending ends 18 and 19 of driver loops 16 and 17 against outward movement with respect to each other. This means comprises a frustum 20 of thin spring metal functionally integral with the ends 18 and 19, respectively, of driver loops 16 and 17. Frustum 20 together with the U shaped output loop 11, driver loops 16 and 17 and U member may conveniently be fabricated as a stamping from a conventional disc or "Belleville" spring.

Figure 1A:
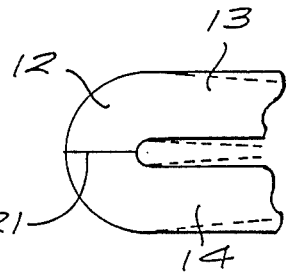
FIG. 1A is a fragmentary view of a portion of the central output loop showing its stressed configuration in dotted lines.

After completion of the fabrication of the assembly just described, the legs 13 and 14 of the output loop 11 are stressed so as to bring the ends of the legs connected to the driver loops 16 and 17 closer together as shown in dotted lines in FIG. 1A, than the opposite ends of those legs. This may be accomplished either by increasing the spacing between the legs at the closed end 12 of the loop 11, as by peening the metal along the line 21, by decreasing the spacing between the legs at the open end of loop 11, as by peening the metal of one or both of the driver loops 16, 17 along the lines 22, 23 or otherwise widening one or more of the loops 11, 16 and 17.

Figure 2A:
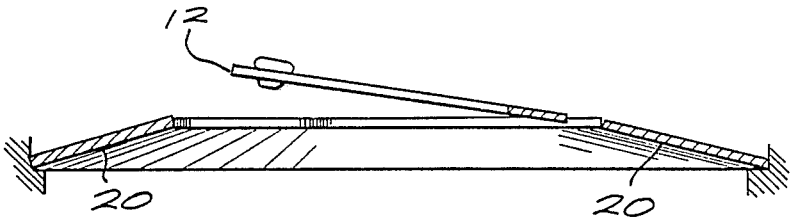
FIGS. 2*a* and 2*b* are views in section of the device of FIG. 1 illustrating the two positions which the "U" shaped portion may assume in operation.
Figure 2B:
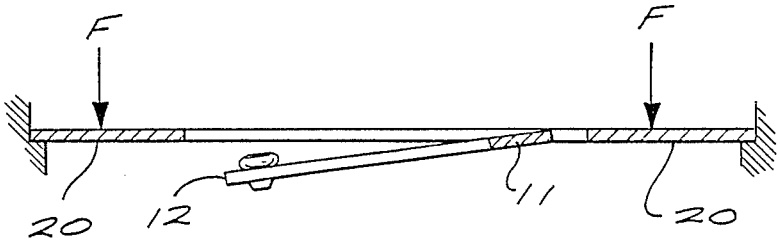

The movement transmitting and amplifying device of the present invention fabricated as described above initially has the configuration shown in section in FIG. 2*a*, but when pressure of a predetermined magnitude is applied to some portion of the upper surface of the frustum 20, for example, adjacent its connection with the driver loops 16, 17, the device will assume the configuration shown in FIG. 2*b*; the magnitude of movement of the free end 12 of output loop 11 being approximately ten times that of the portion of the device to which pressure was applied. Upon release of the pressure applied to the upper surface of the frustum 20, the resilience of the frustum will cause restoration of the device to the configuration shown in FIG. 2*a*.

If, however, a flat sheet of spring metal is substituted for a disc spring in fabricating the device of the present invention as described above, the device will operate in the same way except that it will not restore to its original configuration upon release of the activating pressure. Restoration of a device so constructed responsive to actuation forces F applied to the embodiment of FIGS. 5 and 5A must be accomplished by pressure applied in a direction opposite to the activating pressure.

An example of such return force applying means is illustrated structurally in FIG. 5 and operationally as return springs 25 and 26 in FIG. 5A. In this modification of the device of the present invention, the outer edge of a flat sheet of spring metal 10*a* configuration as shown in FIG. 5, is urged into the position shown in FIG. 5A by compression springs 25 and 26 engaging opposite points on its periphery. The spring metal 20 is supported at two discrete points or a full or partial annular fulcrum intermediate its edge and the "W" portion of opposite fulcrum members 29 and 39.

In this position, the free end 12 of its output loop engages an electrical contact 27 carried by the base. However, when downward pressure overcomes springs 25 and 26, the device snaps over to the position shown in dotted lines in FIG. 5A, so that the free end 12 engages a contact 28.

Also, if the frustum 21 is segmented as shown in FIG. 5, the output loop 11 will not automatically restore to the position shown in FIG. 2*a* upon release of pressure applied to the frustum 20, but will remain in position shown in FIG. 2*b* until pressure is applied to the opposite side of the frustum 20. Alternatively, the segment may be supported by opposing springs means such as the springs 25 and 26 of FIG. 5A to effect restoration to its former position and provide an elastic load resisting element.

It is not necessary that the strip 10 be formed integrally with the frustum 20, as shown in FIGS. 1, 2*a*, 2*b* and 5, but only that they be connected as shown in FIGS. 3 and 4 as by strips 30 of dielectric material embracing the ends of the strip 10 and the inner edge of the central opening of frustum 20 and connected together by rivets 31.

While the motion transmitting and amplifying device of the present invention is useful in any of a wide variety of environments in which a small sensed displacement is required to produce a control signal as by opening or closing an electrical circuit or valving a pneumatic control, FIGS. 6, 7 and 8 of the accompanying drawings show it as embodied in a pneumatic sensing electrical switch.

As shown in FIG. 6, the switch comprises a cylindrical internally threaded casing 50 into which there is threaded a cylindrical switch base 51 carrying adjacent its upper end a motion transmitting and amplifying device of the construction shown in FIGS. 1–4, 5 or 5A the outer edge of which is seated on a wire loop 52 retained in the base 51. A block of insulating material 53 carried by the base 51 supports an upper contact 54 which projects through the central opening of the frustum 20 and overlies the free end of the output loop 11.

Also supported by the block 53 is a lower contact 55 which underlies the free end of the output loop 11 and, as shown in FIG. 7, is engageable thereby in the displaced position of the output loop 11. The wire loop 52 terminates in a conductor 56 which is electrically connected to a lead 57. Separate conductors 57, 58, and 59 provide electrical connections between contacts 54 and 55 and exterior contacts 61, 62 and 63 carried by an extension 64 of casing 50.

Means are provided for causing the output loop 11 to move from the position in which it is shown in FIG. 6 to the position in which it is shown in FIG. 7. This means comprises a cap 65 secured as by welding to the upper end of the casing 50 and provided with a port 66 through which fluid under pressure may be admitted to a cavity 67 in the cap 65 via passages 68 and 69. A diaphragm 70 divides the cavity 67 into upper and lower portions, and contained in the lower portion is a pressure plate 71 engaging the underside of the diaphragm 70.

Centrally connected to the pressure plate 71 and slideably mounted in the lower portion of the cap 65 is an actuator 72 which carries at its lower end a cup shaped register 75 the free lower edges of which engage a washer 76 of insulating material overlying frustum 20 to electrically insulate it from the register 75.

Downward pressure is exerted on a diaphragm 70 and pressure plate 71 by a spring 80 the compression of which is adjustable by means of a hollow pin 81 threaded into the port 66 and exerting pressure against a cup 82 bearing on the diaphragm 70 centrally of the pressure plate 71.

In operation, the pressure exerted by the spring 80 may be adjusted up to the point of almost overcoming the resistance of the frustum 20 in the position in which it is shown in FIG. 6. This provides a range of adjustment of pneumatic pressures needed to be introduced through the port 66 to be sufficient to depress the diaphragm 70 and pressure plate 71 causing the output loop 11 to move from engagement with the upper contact 54 and into engagement with the lower contact 55.

It is to be understood that the present invention is not limited to the details of the illustrative embodiments particularly described herein, but that various modifications may be made without departing from the invention as defined in the claims.

I claim:

1. A method of fabricating a motion transmitting and amplifying device including the steps of fabricating a strip of spring metal configured to resemble the letter W which comprises a pair of driver portions having parallel legs with an output portion loop; one leg of each of said driver portions being connected to a different leg of said output portion, providing means connecting the ends of said driver loops opposite their connections with the output loop for constraining said ends against outward movement with respect to each other; and then stressing the legs of the output portion to tend to reduce the spacing between the output legs as the legs approach the driver portions.

2. A method of fabricating a motion transmitting and amplifying device according to claim 1 in which said strip and said connecting means are fabricated from a single sheet of spring metal.

3. A method of fabricating a motion transmitting and amplifying device according to claim 1 in which said strip and said connecting means are fabricated from a disc spring.

* * * * *